US006776586B2

(12) United States Patent
Naito et al.

(10) Patent No.: US 6,776,586 B2
(45) Date of Patent: Aug. 17, 2004

(54) MULTI-STAGE VACUUM PUMP

(75) Inventors: Yoshihiro Naito, Nagoya (JP); Kazuo Noso, Toyoake (JP); Kazuaki Nakamura, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/278,950

(22) Filed: Oct. 24, 2002

(65) Prior Publication Data

US 2003/0077182 A1 Apr. 24, 2003

(30) Foreign Application Priority Data

Oct. 24, 2001 (JP) ..... 2001-326779

(51) Int. Cl.[7] ..... F04B 25/00; F04B 3/00; F04B 5/00

(52) U.S. Cl. ..... 417/244; 417/410.4; 417/199.1; 418/9; 418/83

(58) Field of Search ..... 417/244, 410.1, 417/310, 283, 410.4, 199.1, 53; 418/171, 166, 9, 95–96, 88, 205, 206, 83, 9.15, 104, 206.3

(56) References Cited

U.S. PATENT DOCUMENTS

| | | | | |
|---|---|---|---|---|
| 4,770,609 A | * | 9/1988 | Uchida et al. | 417/2 |
| 5,356,275 A | * | 10/1994 | Brenner et al. | 418/9 |
| 5,816,782 A | * | 10/1998 | Nagayama et al. | 417/410.4 |
| 6,471,497 B2 | * | 10/2002 | Suzuki et al. | 418/9 |

FOREIGN PATENT DOCUMENTS

| | | | | |
|---|---|---|---|---|
| EP | 0 272 767 | | 6/1988 | |
| EP | 0 359 423 | | 3/1990 | |
| GB | 480522 | | 2/1938 | |
| GB | 625490 | | 6/1949 | |
| GB | 856601 | | 12/1960 | |
| GB | 2 088 957 | | 6/1982 | |
| JP | 0 539 423 | A2 * | 3/1990 | ..... F04C/23/00 |
| JP | 2-95792 | | 4/1990 | |
| JP | 05118290 | A * | 5/1993 | ..... F04C/25/02 |
| JP | 3051515 | | 6/2000 | |

* cited by examiner

*Primary Examiner*—Justine R. Yu
*Assistant Examiner*—Han L Liu
(74) *Attorney, Agent, or Firm*—Oblon, Spivak, McClelland, Maier & Neustadt, P.C.

(57) ABSTRACT

The present invention provides a multi-stage vacuum pump which includes: a housing in which a plurality of pumping chambers are formed, the pumping chambers being arranged in series and being in fluid communication with one another, one of the pumping chambers which is at one end of the series acting as an initial stage pumping chamber, another of the pumping chamber which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pumping chamber; a Roots-type pump section occupying each of the pumping chambers; and a device for decreasing a temperature differential between the initial stage pumping chamber and the final stage pumping chamber.

11 Claims, 9 Drawing Sheets

MULTI-STAGE VACUUM PUMP

The present application is based on and claims priority under 35 U.S.C §119 with respect to Japanese Patent Application No.2001-326779 on Oct. 24, 2001 (13th Year of Heisei), the entire content of which is incorporated herein by reference.

BACKGROUND OF THE INVENTION

1. Field of the Invention

The present invention is generally directed to a multi-stage vacuum pump and in particular to a multi-stage vacuum pump whose inner structure is improved such that in-vacuum-pump substances which are easy to coagulate are made free from solidification by utilizing heat of compression resulting from generates upon gas compression.

2. Prior Art

In general a conventional multi-stage vacuum pump of the type is constructed to have a plurality of in-series pumping chambers each of which accommodates a pair of intermeshing rotors which are all of a "Roots"-type profile. The pair of "Roots"-type rotors which are provided in each pumping chamber is rotated therein to make a space evacuated which is connected to an inlet port or suck port of the pumping chamber by compressing a gas sucked from the space to be evacuated. While the rotors are being in rotation, a heat of compression is generated due to the gas compression, which is cooled by water or air in order to prevent a temperature increase of a housing of the multi-stage vacuum pump.

While the multi-stage vacuum pump is in operation, the resulting compression load generates a heat of compression, which increases the temperature of the housing of the multi-stage vacuum pump. As well known, the heat of compression becomes much larger at an exhaust or outlet port than the inlet or suck port, in resulting very large temperature differential therebetween.

In the conventional multi-stage vacuum pump, a specific gas to be exhausted such as ammonium chloride is brought into condensation or solidification at ordinary temperature or its near region as viewed from saturation vapor pressure curve. Thus, when such a specific gas is sucked, the resulting gas is cooled down, in the pumping chamber of earlier stage which is relative low in temperature, below a temperature of solidification, which causes the gas to solidify or condense, resulting in a deposit at a portion such as an interface between the rotor and the housing in the pumping chamber, whereby drawbacks may occur such as pump overload when the rotors in rotation and/or stopping the rotation of each of the rotors.

For example, in Japanese Patent Publication No. 3051515 provides a multi-stage vacuum pump whose structure is shown in FIG. 9. In this structure, a common cooler 47 is provided to cool down each of different stage pumping chambers from which gases are exhausted with heat generation. In addition, in this structure, four pumping chambers 42, 43, 44, and 45 are defined in a housing 40 such that its lower wall portion 46 closes exhaust ports of the respective pump chambers 42, 43, 44, and 45. The lower wall portion 46 is connected with a cooler 47 through which a cooling water passes, which establishes an indirect cooling of the housing 40 via the lower wall portion 46.

In "Roots"-type vacuum pumps, in general noise generation is at issue which results from particular that the Roots profile rotors in the chamber adjacent the pump outlet expelling discrete trapped volumes of evacuated gas to atmosphere from between the Roots rotors. To prevent the generation of such noise, in the conventiol "Roots"-type vacuum pumps, a silencer is provided in a spaced manner from the pump housing.

However, in the above-described conventional "Roots"-type vacuum pump, the compression heat generation is caused by the compression work at each of pumping chambers such that the compression work becomes larger at higher stage pumping chamber. Thus, the temperature of the gas sucked into the inlet port is made larger as being transferred to higher stage pumping chamber in the order the first-stage, second-stage, third-stage, and fourth-stage pumping chambers, resulting in that the temperature of the gas becomes maximum near or at the outlet port of the fourth-stage pumping chamber. This causes a thermal gap or temperature differential between the inlet port and outlet port. Consequently, if the gas which is to be evacuated contains therein a condensable gas such as ammonium chloride is brought into condensation or solidification at ordinary temperature or its near region as viewed from its own saturation vapor pressure curve. Thus, when such a gas is sucked, the resulting gas is cooled down, in the pumping chamber of earlier stage which is relative low in temperature, below a temperature of solidification, which causes the gas to solidify or condense, resulting in a deposit at a portion such as an interface between the rotor and the housing in the pumping chamber, whereby drawbacks may occur such as pump overload when the rotors in rotation and/or stopping the rotation of each of the rotors.

In addition, adding the silencer to the conventional "Roots"-type vacuum pump results in an increase of the number of parts, an increase of production cost, and an increase of mass or outer scale.

Thus, a need exists to provide a "Roots"-type multi-stage vacuum pump which is free from the above-described drawbacks, which is capable of, by simple structure, exhausting sucked gas without solidifying the same, and which is made, at a lower cost, free from compression noise upon gas exhaustion.

SUMMARY OF THE INVENTION

Accordingly, in order to meet the above need to overcome the aforementioned drawbacks or problems, a first aspect of the present invention provides a multi-stage vacuum pump which comprises:

a housing in which a plurality of pumping chambers are formed, the pumping chambers being arranged in series and being in fluid communication with one another, one of the pumping chambers which is at one end of the series acting as an initial stage pumping chamber, another of the pumping chamber which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pumping chamber;

a Roots-type pump section occupying each of the pumping chambers; and first means for decreasing a temperature differential between the initial stage pumping chamber and the final stage pumping chamber.

A second aspect of the present invention is to provide multi-stage vacuum pump whose gist is to modified the structure of the first aspect, wherein the inlet port and the outlet port of the housing are placed near the initial stage pumping chamber, the first means is in the form of a passage connecting between the inlet port and the outlet port.

A third aspect of the present invention is to provide a multi-stage vacuum pump whose gist is to modify the structure of the second aspect, wherein the passage extends along a lengthwise a of the housing.

A fourth aspect of the present invention is to provide a multi-stage vacuum pump whose gist is to modify the structure of the second aspect, wherein the passage is modified to act concurrently as a built-in silencer.

A fifth aspect of the present invention is to provide a multi-stage vacuum pump whose gist is to modify the structure of the first aspect to comprise further second means for cooling a heat of compression generated at each of the pumping chambers.

A sixth aspect of the present invention is to provide a multi-stage vacuum pump whose gist is to modify the structure of the fifth aspect, wherein the second means is in the form of one more cooling fluid flowing passages which are so formed in the housing as to be near the first means.

A seventh aspect of the present invention is to provide a multi-stage vacuum pump whose gist is to modify the structure of the sixth aspect, wherein the cooling fluid flowing passage is a tube which is in thermal contact with the housing.

An eighth aspect of the present invention is to provide a multi-stage vacuum pump whose gist is to modify the structure of the fifth aspect, wherein the second means is in the form of fins formed integrally with the housing.

A ninth aspect of the present invention is to provide a multistage vacuum pump whose gist is to modify the structure of the first aspect to comprise further a check-valve provided in the outlet port.

A tenth aspect of the present invention is to provide a multi-stage vacuum pump whose gist is to modify the structure of the fourth aspect, wherein making the passage to have different inner diameter forms the built-in silencer.

An eleventh aspect of the present invention is to provide a multi-stage vacuum pump whose gist is to modify the structure of the fourth aspect, wherein making the passage curved forms the built-in silencer.

A twelfth aspect of the present invention is to provide a multi-stage vacuum pump whose gist is to modify the structure of the fourth aspect, wherein providing a sound-absorbing material in the passage forms the built-in silencer.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Hereinafter, preferred embodiments of the present invention will be described in great detail with reference to the attached drawings.

[First Embodiment]

Figure 1:
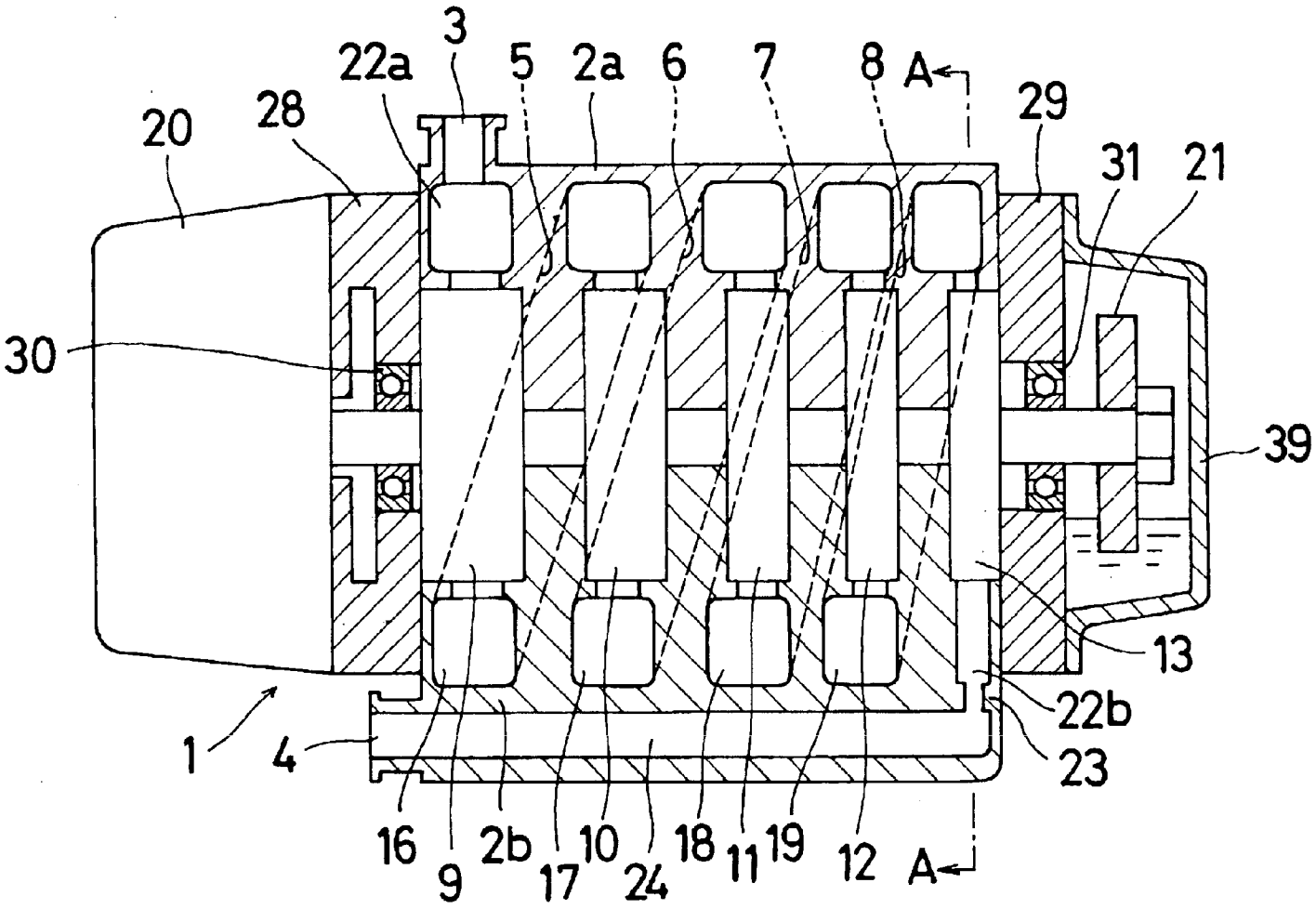
FIG. 1 is a cross-sectional view of a principal pr main portion of a "Roots"-type multi-stage vacuum pump in accordance with a fist embodiment of the present invention.
Figure 2:
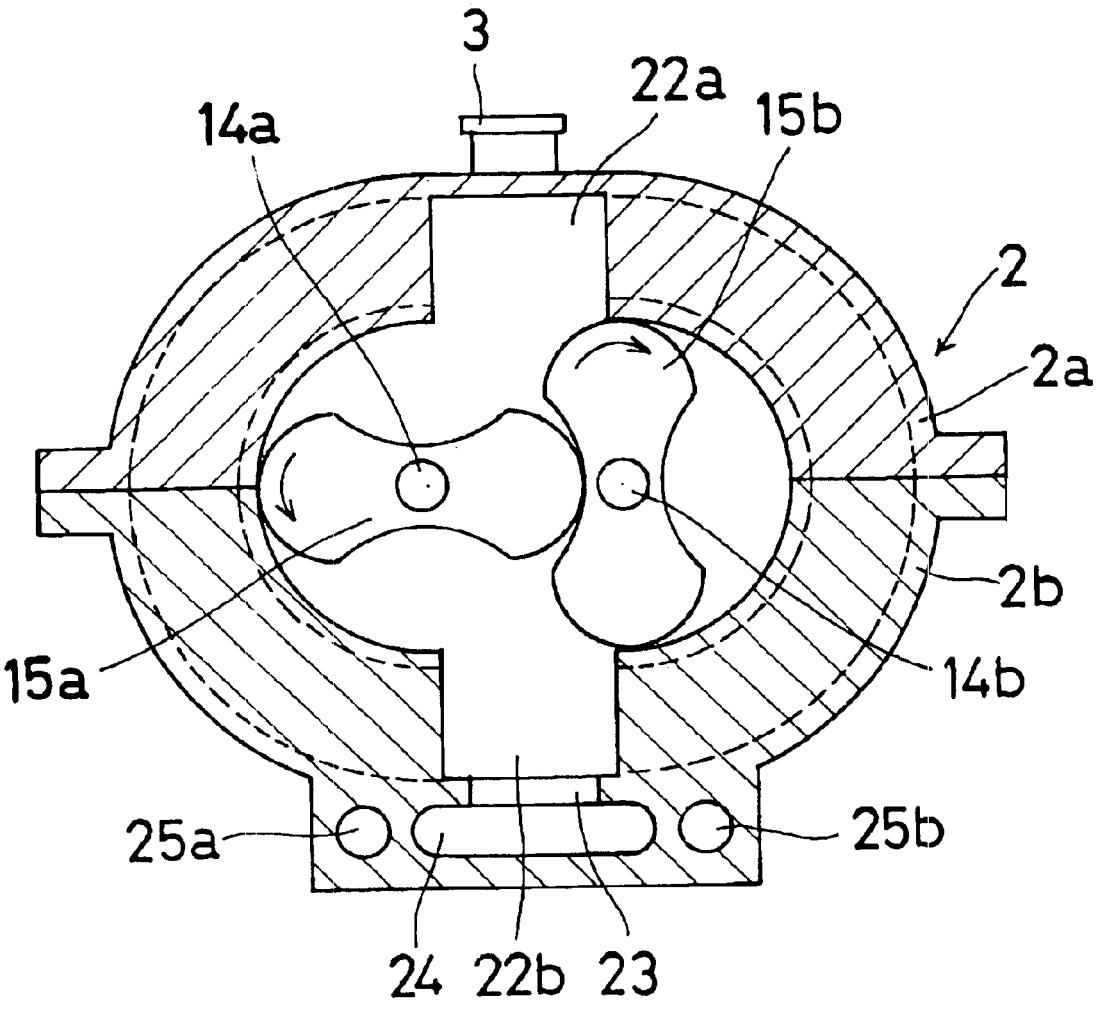
FIG. 2 is a cross-sectional view taken along line A—A in FIG. 1.

Referring first to FIGS. 1 and 2, there is illustrated a "Roots"-type multi-stage vacuum pump 1 which will be called simply pump. FIG. 1 illustrates an inner structure of the pump 1 and FIG. 2 is a cross-sectional view taken along line A—A in FIG. 1. The pump 1 includes complementary housing members 2*a* and 2*b* which constitute a housing 2, a pair of side covers 28 and 29 which are coupled to opposite ends of the housing 2, an electric motor 20 secured to the side cover 28, and an oil cover 39 secured to the side cover 29.

At a central portion inside the housing 2, as depicted in FIG. 2, there are provided a pair of paralelly arranged shafts 14*a* and 14*b* which extend along an axial direction of the housing 2. The housing member 2*a* is formed at its upper side thereof with an integral inlet port 3. The inlet port 3 is in fluid communication with a space (not shown) to suck a gas stored therein for establishing an evacuated state of the space. The inlet port 3 is placed at a side of the motor 20. The housing 2 has an integral outlet port 4 from which the gas is exhausted outside the pump 1 after passing through the housing 2. The outlet port 4 is placed below the housing member 2*b* and is opened to a lower side of the motor 20.

Within the hosing 2 constructed by the complementary housing members 2*a* and 2*b*, there are provided four axially spaced wall partitions 6, 6, 7, and 8 to define five pumping chambers: a first pumping chamber 9, a second pumping chamber 10, a third pumping chamber 11, a fourth pumping chamber 12, and a fifth pumping chamber 130. These five pumping chambers are designed to compress the sucked gas from the space to be evacuated in stepwise fashion such that each pumping chamber is designed to compress the gas. In each pumping chamber, the shafts 14*a* and 14*b* support Roots-type profile rotors 15*a* and 15*b*, respectively. The shafts 14*a* and 14*b* are adapted for rotation within the housing 2 about theirs longitudinal or lengthwise axes in contra-rotational direction by virtue of the shaft 14*a* being connected to the motor 20 and by the shaft 14*b* being coupled to the shaft 14*a* by means of timing gears in a manner known per se. The Roots-type profile rotors 15*a* and 15*b* are located in each pumping chamber relative to an internal surface of the housing 2 such that the Roots-type profile rotors 15*a* and 15*b* can act in an intermeshing manner in a manner per se in respect of vacuum pumps.

The pumping chambers 9, 10, 11, and 12 are in fluid communication with the pumping chambers 10, 11, 12, and 13 by way of passages 16, 17, 18, and 19, respectively, which are formed in circumferential fashion in the housing 2. Each passage connects two adjacent pumping chambers, which causes the pumping chamber 9, 10, 11, 12, and 13 to connect in series. Thus, the gas sucked into the inlet port 3 is brought into 5-stage compression process (i.e. is compressed five times in different pumping chambers), and is exhausted outside the pump 1 from the outlet port 4 such that the gas when being exhausted becomes hot due to five-time compressions. It is to be noted that the pumping chambers are same internal surface. However, higher stage pumping chamber is smaller than lower stage pumping chamber in axial length or thickness, which causes the volumes of the respective pumping chambers 9, 10, 11, 12, and 13 to decrease in stepwise fashion in this order.

In the pump 1 having the above-described structure, the inlet port 3 is in fluid communication with a suction space 22*a* which is defined by an inner wall of the first pumping chamber 9, and the pair of the rotors 15 and 15*b*. An exhaust space 22*b* is defined by in the fifth pumping camber 13 and its pair of the rotors is in fluid communication with a diameter-reduced passage 23 which formed below the fifth pumping chamber 13 and which is of smaller diameter than the axial length. The diameter-reduced passage 23 is in fluid communication with a passage 24 which extends along an outside surface of the housing member 2*b* so as to lie next to the passages 16, 17, 18, and 19. The passage 24 runs near the pumping chambers 9, 10, 11, 12, and 13 and the passages 16, 17, 18 so as to be in fluid communication with the outlet port 4, which makes it possible to exhaust the gas outside the pimp 1 which has been compressed in stepwise manner at the in-series arranged pumping chambers 9, 10, 11, 12, and 13.

Opposite ends of the housing 2 which is constructed by the complementary housing members 2*a* and 2*b* are coupled with the side cover 28 and the side cover 29 to closed open ends of the respective first pumping chamber 9 and the fifth pumping chamber 13. A pair of bearings 30 and 30 (only one is shown) are provided in the side cover 28, while a pair of bearings 31 and 31 (only one is shown) are provided in the side cover 29. Opposite ends of the shaft 14*a* are supported by one of the bearings 30 and one of the bearings 31 for rotation, while opposite ends of the shaft 14*b* are supported by the other of the bearings 30 and the other of the bearings 31 for rotation. The bearings 30, 30, 31, and 31 are arranged so as to ensure the parallel relationship between the shafts 14*a* and 14*b*. The shaft 14*a* is coupled to an output shaft of the motor 20 and is brought into concurrent rotation with the output shaft when the motor 20 is turned on. The other end of the shaft 14*a* and the other end of the shaft 14*b* extend outside the side cover 29 and are coupled with a pair of meshing timing gears 21 and 21 (only one is illustrated). The timing gears 21 and 21 ensures to rotate the shafts 14*a* and 14*b* at a same speed but in opposite direction (i.e. to synchronize the shafts 14*a* and 14*b* to rotate). The timing gears 21 and 21 are accommodated in an oil cover 39 to be protected which is secured to a right side of the side cover 29. Within an inner space of the oil cover 39, an amount of lubrication oil is stored. Thus, making a portion of an outer periphery of each of the timing gears 21 and 21 immersed in the oil while the timing gears are in rotation results in that the meshing engagement between the timing gears 21 and 21 is always in lubricated state.

The above-described force transmission mechanism makes it possible, when the motor 20 is turned on, to rotate the pair of the shafts 14*a* and 14*b* in opposite directions, thereby sucking by way of the inlet port 3 the gas in the space to be evacuated.

The housing member 2*b* has an integral pair of axially spaced cooling passages 25*a* and 25*b* which runs along or parallel to the passage 24 trough which the compressed gas whose temperature is very high due to the heat of compression moves to the outlet port 4 for being exhausted outside the pump 1. Flowing cooling fluid such as cooling water through the cooling passages 25*a* and 25*b* makes it possible to establish efficient absorption of heat from heat of compression whenever the gas is compressed in each of the pumping chambers 9, 10, 11, 12, and 13.

It is to be noted that one of the cooling passages 25*a* and 25*b* can be omitted. In addition, when the amount of the gas to be exhausted from the outlet port is small and the heat of compression is small and/or when the gas is free from condensation and solidification during operation of the pump 1, both the cooling passages 25*a* and 25*b* can be omitted.

In operation, first of all, the gas to be exhausted from the outlet port 4 of the pump 1 while the pump 1 is in operation is sucked into the inlet port 3. The resulting gas is moved or flown into the sucking space 22*a* and is compressed by the pair of the Roots-type profile rotors 15*a* and 15*b* which are fixedly mounted on the respective shafts 14*a* and 14*b* in rotation.

The gas is, at first, brought into compression in the first pumping chamber 9, the resulting gas is moved into the exhaust space 22*b*, and is fed by way of the passage 16 into the suck space of the next stage or the second pumping chamber 10. The gas fed in the second pumping chamber 10 is, similar in the first pumping chamber 9, brought into compression. In the subsequent pumping chambers 11, 12, and 13, similar compressions are, respectively, done. Thus the gas compressed in stepwise manner is fed from the exhaust space 22*b* of the fifth pumping chamber 13, by way of the radius-reduced passage 23 and the passage 14, to the outlet port 4 for being exhausted outside the pump 1.

As to the above-mentioned gas compression which is done at each of the pumping chamber, the theoretical compression load L at each stage is represented by the following equation or formula.

$$L=C\times Q\times(P1-P2)$$

where

C: proportionality constant

Q: amount of gas to be exhausted

P1: pressure of gas when exhausted

P2: pressure of gas when sucked

In the present embodiment, the exhaust space 22 of the fifth pumping chamber 13 as the final stage of the pump 1 is in fluid communication with the outlet port 4 by way of the passages 23 and 24. Thus, when the gas which has been compressed in the fifth pumping chamber 13 is in hot-temperature state due to heat of compression moves into the passage 24 from the exhaust space 22 of the fifth pumping chamber 13 as the final stage of the pump, a heat transfer occurs due to temperature differential between the gas and the housing member 2*b*. In detail from the gas in the passages 24 the heat is transferred to an inner surface or wall of the passage 24 and the resulting heat is transferred to the passages 16, 17, 18, and 19 which are located inner than the passage 24. Then, the heat transmitted to each of the passages 16, 17, 18, and 19 is transmitted to the pumping chambers 9, 10, 11, 12, and 13. Thus, the heat of compression of the gas which is to be exhausted from the outlet port 4 causes the temperature in each of the pumping chambers 9, 10, 11, 12, and 13 to increase.

The first pumping chamber 9 is small in compression load and is placed in the vicinity of the inlet port 3 of lower temperature, which makes temperature differential between the it pumping chamber 9 and the gas in the passage 24 larger than the temperature differential between any one of the other pumping chambers 10, 11, 12, and 13 and the gas in the passage 24. Thus, correspondingly, the amount of heat transfer to the first pumping chamber 9 becomes large, which makes the temperature in the first pumping chamber 9 easy to increase, resulting in ensuring maintenance of a temperature differential as small as possible between the initial stage or first pumping chamber 9 and the final stage or fifth pumping chamber 13.

In detail, as previously explained, in each of the pumping chambers 9, 10, 11, 12, and 13, the heat of compression is generated depending on the compression load L=C×Q×(P1−P2). According to this, while the pump 1 is being in steady operation, the temperature near the exhaust space 22*b* of the final stage or fifth pumping chamber 13 becomes maximum in which the compression load is large. In the present embodiment, the gas which is of the maximum temperature and which is exhausted from the exhaust space 22*b* of the final stage or fifth pumping chamber 13 is made transferred or fed to the passage 24 which is formed at the lower side of the housing 2 such that the higher-tempered heat of compression is transmitted by way of the inner wall of the passage 24 to the pumping chambers 9, 10, 11, 12, and 13.

This results in minimum temperature differential between the initial stage or fist pumping chamber 9 and the final stage or fifth pumping chamber 13, which makes the gas to be exhausted free from being condensed and/or solidification, resulting in prevention of overload operation or unexpected stoppage of the pump 1.

The above-mentioned heat of compression is cooled down to a temperature, when the compression load is large, by flowing the cooling medium such as cooling water through the cooling passages 25*a* and 25*b* which are formed or located near the passage 24.

Figure 3:
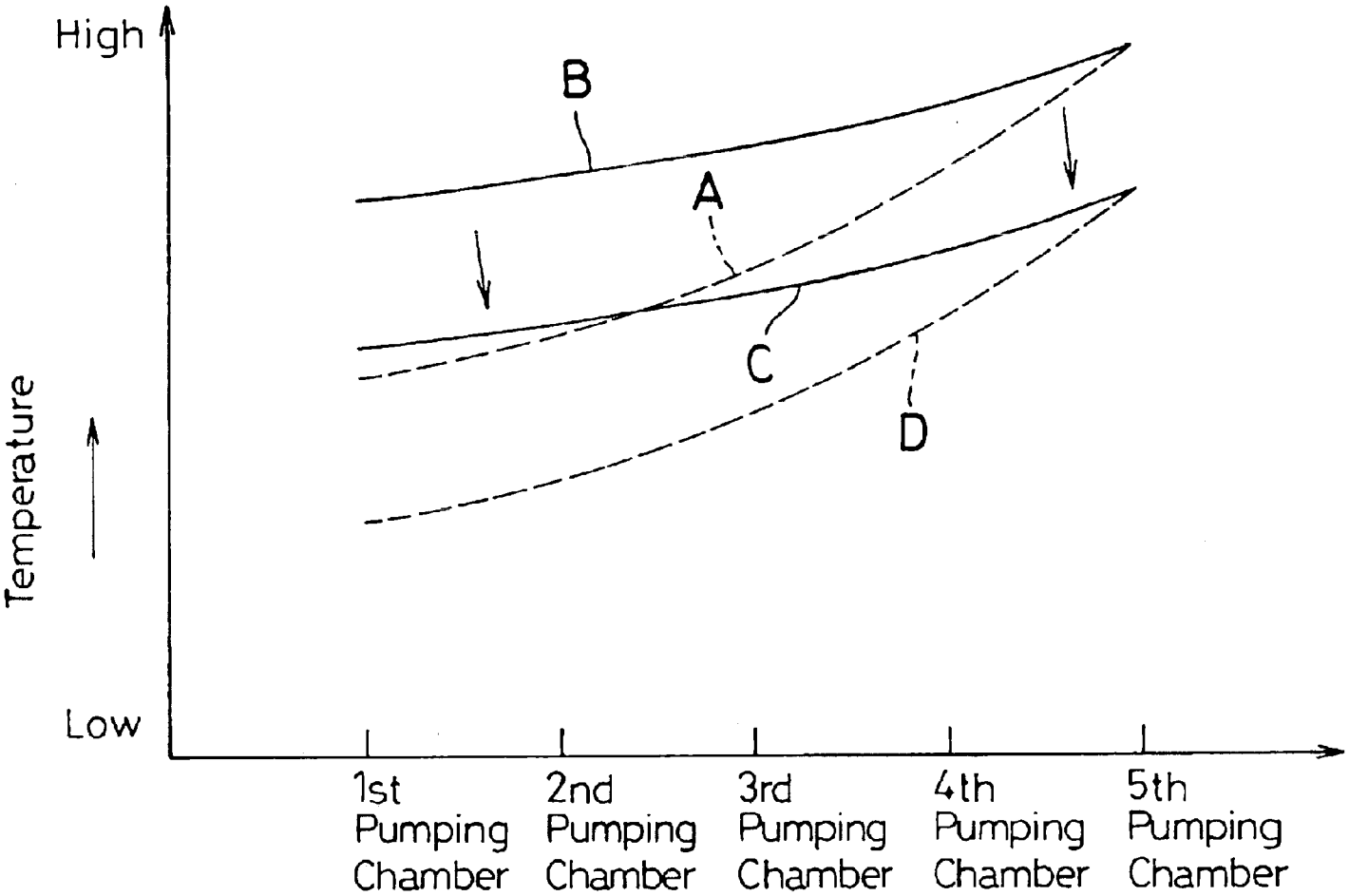
FIG. 3 is a graph indicating temperature change in each pumping chamber of the present invention when compared to those of the conventional device.

In detail with reference to FIG. 3, if the pumping chambers 9, 10, 11, 12, and 13 are not cooled down according to the conventional manner, as a whole, the temperature of the housing of the pump 1 becomes very high, which expands or spreads the temperature differential between the initial stage or first pumping chamber 9 and the final stage or fifth pumping chamber 13, resulting in obtaining curve 'A'. Under such a situation, the lower portion of the housing 2 is wholly or entirely cooled by cooling water, the gas passing through each of the pumping chambers 9, 10, 11, 12, and 13 are cooled, resulting in obtaining curve 'D' which is indicative of the housing temperature of the pump 1 and which is at a lower position than the curve 'A'. The temperature differential between the first pumping chamber 9 and the fifth pumping chamber 13 does not decrease to remain large.

However, the above-detailed structure causes the gas which is of the highest-temperature heat of compression to move or flow through all the pumping chambers 9, 10, 11, 12, and 13, which warms the passages 16, 17, 18, and 19 and the pumping chambers 9, 10, 11, 12, and 13. Thus, the temperature differential between two adjacent pumping chambers becomes smaller as indicated by curve 'B'.

In addition, under such a condition, when the cooling fluid is moved through the cooling passages 25*a* and 25*b*, while the housing temperature of the pump 1 is lowered with the temperature differential between two adjacent pumping chambers maintained, thereby obtaining curve 'C'. Thus, the temperature of the first pumping chamber 9 which is the lowest of the pumping chambers becomes higher, which makes the pump 1 free from solidification of substance which is easy to condense even if such a substance moves through the pump 1. Thus, it is possible to prevent an of overload operation or a stoppage of the pump 1.

Other than the above-described first embodiment, various modifications may be made such as the following embodiments.

[Second Embodiment]

Figure 4:
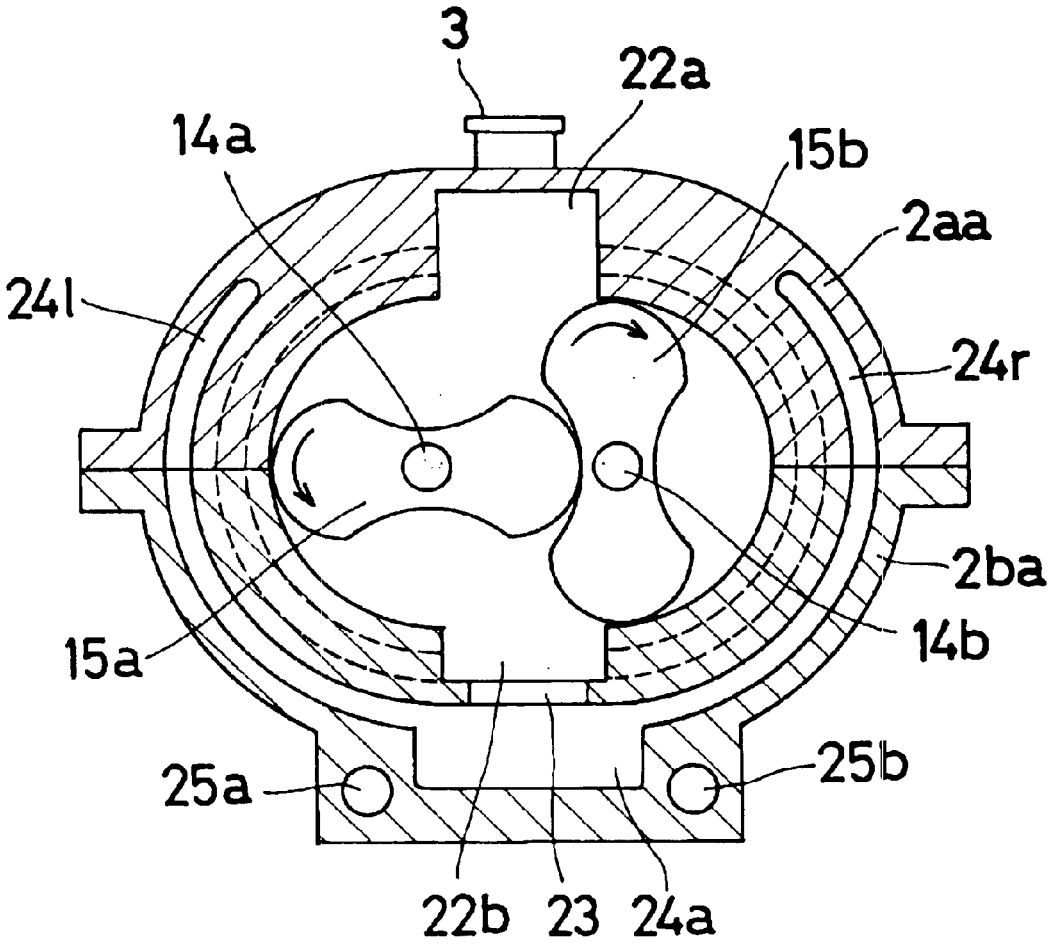
FIG. 4 is a modification of the FIG. 2—illustrated structure as a second embodiment of the present invention.

Referring to FIG. 4, there is illustrated a "Roots"-type multi-stage vacuum pump in accordance with a second embodiment of the present invention. This pump according to the second embodiment is identical with the pump 1 according to the first embodiment except that other than a passage 24*a* additional passages 24*r* and 24*l* are provided which are formed in housing members 2*aa* and 2*ba* for surrounding each pumping chamber, respectively. Thus, each pumping chamber is of much wider heat transmission area to which heat is applied from gas passing through the passages 24*a*, 24*r*, and 24*l*.

In detail as shown in FIG. 4, the passages 24*r* and 24*l* are formed in the respective housing members 2*aa* and 2*ba*. The passages 24*r* and 24*l* are of an arc-shaped cross-section so as to run along the outer profile of each of the pumping chambers 9, 10, 11, 12, and 13. Thus, the high-temperature gas due to heat of compression which passes through the passages 24*a* and the arc-shaped-cross-section passages 24*r* and 24*l* warms each of the pumping chambers 9, 10, 11, 12, and 13 evenly and efficiently, which results in prevention of in-pump solidification of substances which are easy to condensate.

[Third Embodiment]

Figure 5:
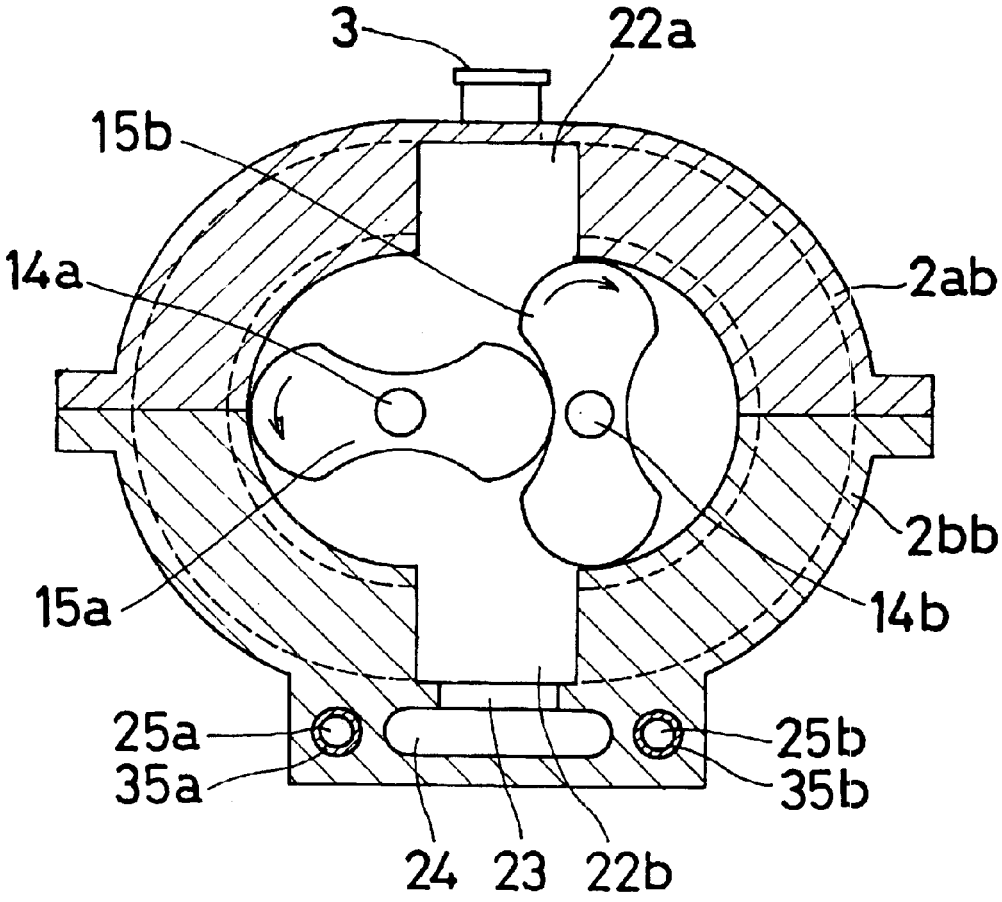
FIG. 5 is a modification of the FIG. 2—illustrated structure as a third embodiment of the present invention.

Referring to FIG. 5, there is illustrated a "Roots"-type multi-stage vacuum pump in accordance with a third embodiment of the present invention. This pump according to the third embodiment is identical with the pump 1 according to the first embodiment except that the cooling passages 25*a* and 25*b* are inserted therein with corrosion-free tubes 35*a* and 35*b*, respectively, for the prevention of possible corrosion of the housing member 2*bb*.

In other words, the FIG. 5—illustrated structure according to the third embodiment of the present invention is constructed or configured by modifying the FIG. 2—illustrated structure such that the inserted corrosion-free tubes 35*a* and 35*b* are in thermal engagement with the respective cooling passages 25*a* and 25*b* by casting, brazing, or other suitable manner. The corrosions tubes 35*a* and 35*b* make surely the housing member 2*b* free from corrosion at the cooling passages 25*a* and 25*b* through which the cooling fluid passes. It is to be noted that the number of the corrosion-free tubes and the position thereof relative to the passage 24 are not limited to the above-mentioned value and positions, respectively.

[Fourth Embodiment]

Figure 6:
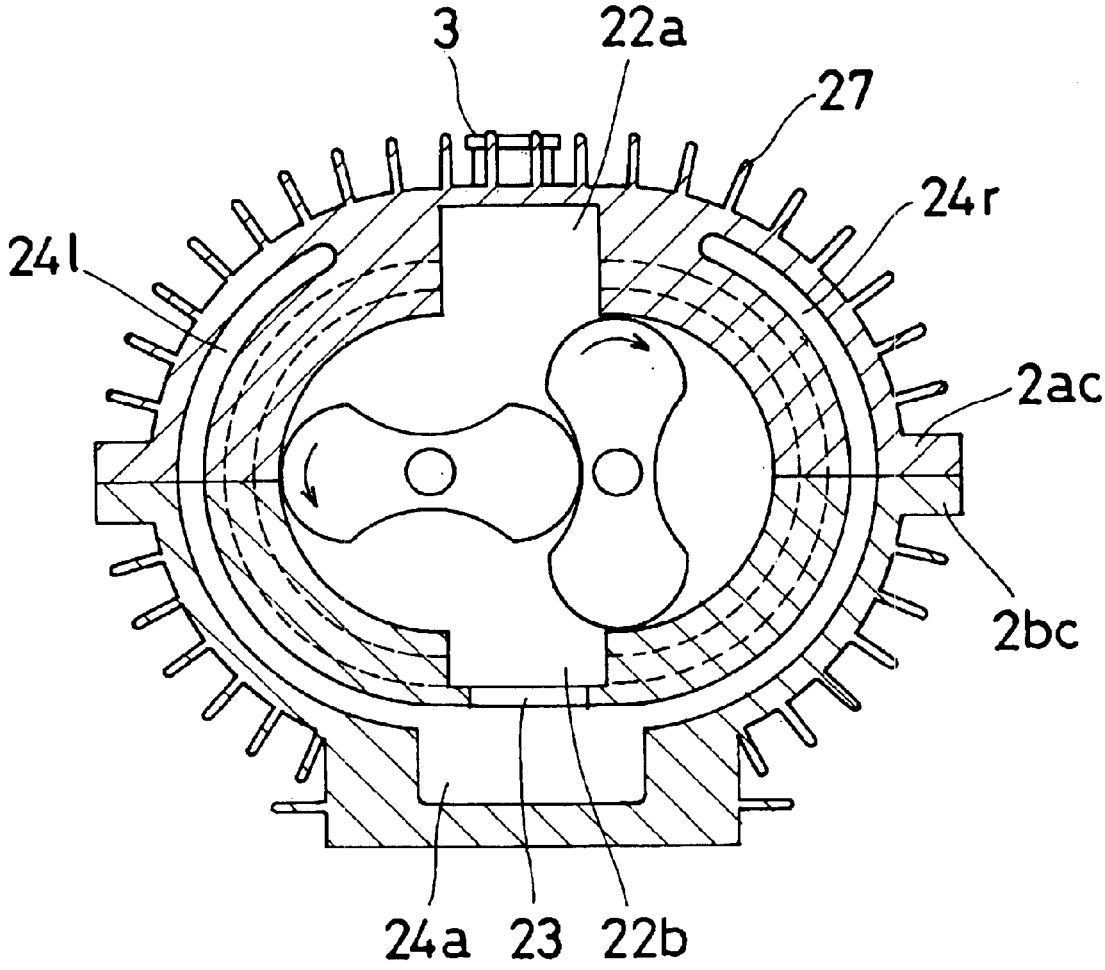
FIG. 6 is a modification of the FIG. 4—illustrated structure as a fourth embodiment of the present invention.

Referring to FIG. 6, there is illustrated a "Roots"-type multi-stage vacuum pump in accordance with a fourth embodiment of the present invention. This pump according to the fourth embodiment a modification of the FIG. 4—illustrated pump according to the second embodiment such that instead of the housing members 2*aa* and 2*bb* housing members 2*ac* and 2*bc* are employed, respectively, which have integral radially-projecting fins 27 for the air cooling.

[Fifth Embodiment]

Figure 7:
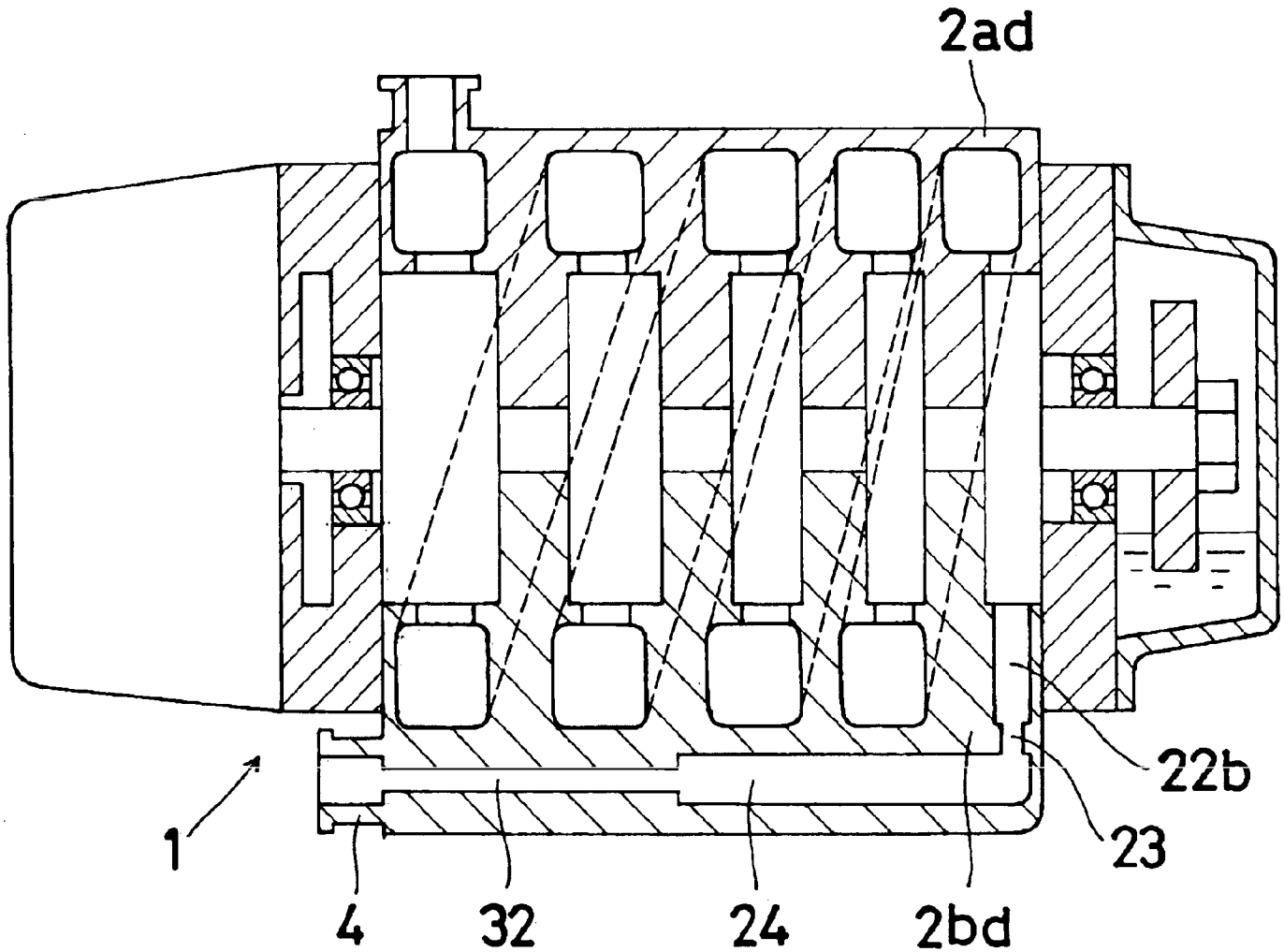
FIG. 7 is a modification of the FIG. 1—illustrated structure as a fifth embodiment of the present invention

Referring to FIG. 7, there is illustrated a "Roots"-type multi-stage vacuum pump in accordance with a fifth embodiment of the present invention which is featured to provide sound deadening effect by adjusting the shape of the passage 24 of the FIG. 1—illustrated structure of the pump 1 according to the first embodiment.

In detail as shown in FIG. 7, the passage 24 extends almost fully in the axial or lengthwise direction of the housing 2 from the exhaust chamber 22*b* of the final stage or fifth pumping chamber 13 to the first pumping chamber 9. This passage 24 is formed into a stepped bore structure such that a smaller-diameter portion 32 is provided at the side of the outlet port 4. Such a diameter-cross-section-area change or adjustment of the passage is capable of resulting in sound deadening effect.

The compressed suction gas flows backward from the outlet port side to each chamber through a small clearance between each of the rotors 15*a* and 15*b* and the inner surface of each of the pumping chambers 9, 10, 11, 12, and 13 at an initial stage of delivery stroke. It is also known that such a backflow of the suction gas produces noise. To prevent such a noise generation, the present embodiment provides, as depicted in FIG. 7, a built-in silencer which is in the form of the stepped bore structured passage 24 instead of the conventional built-out silence which is costly, which is very cumbersome to assemble, and which causes the number of parts to increase. The present embodiment provides the above-described built-in silencer by varying the inner radius of the passage 24 which extends from the exhaust chamber 22 of the final stage or fifth pumping chamber 13 to the outlet port 4, thereby not requiring an external silencer.

[Sixth Embodiment]

Figure 8:
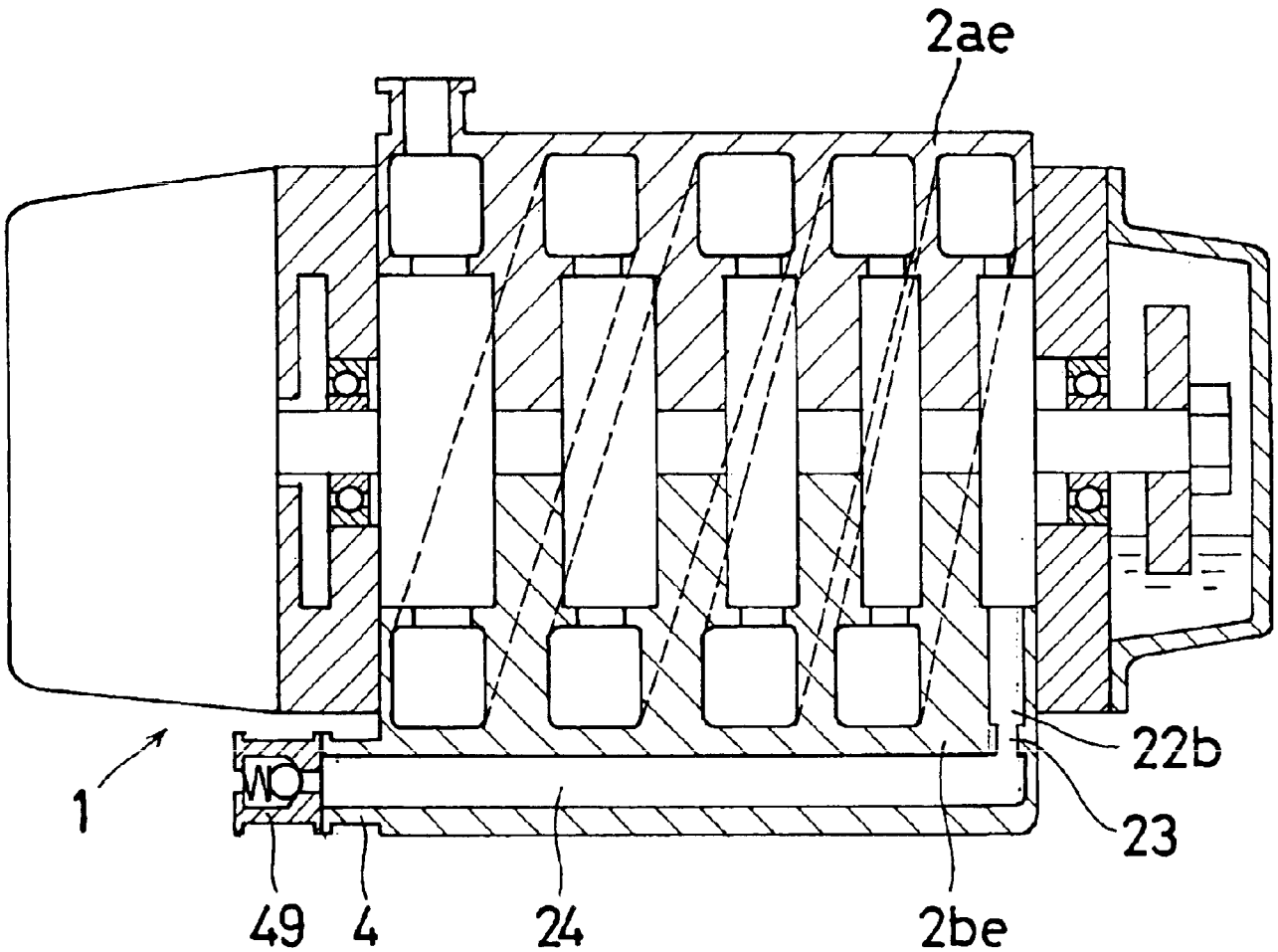
FIG. 8 is a modification of the FIG. 1—illustrated structure as a sixth embodiment of the present invention.
Figure 9:
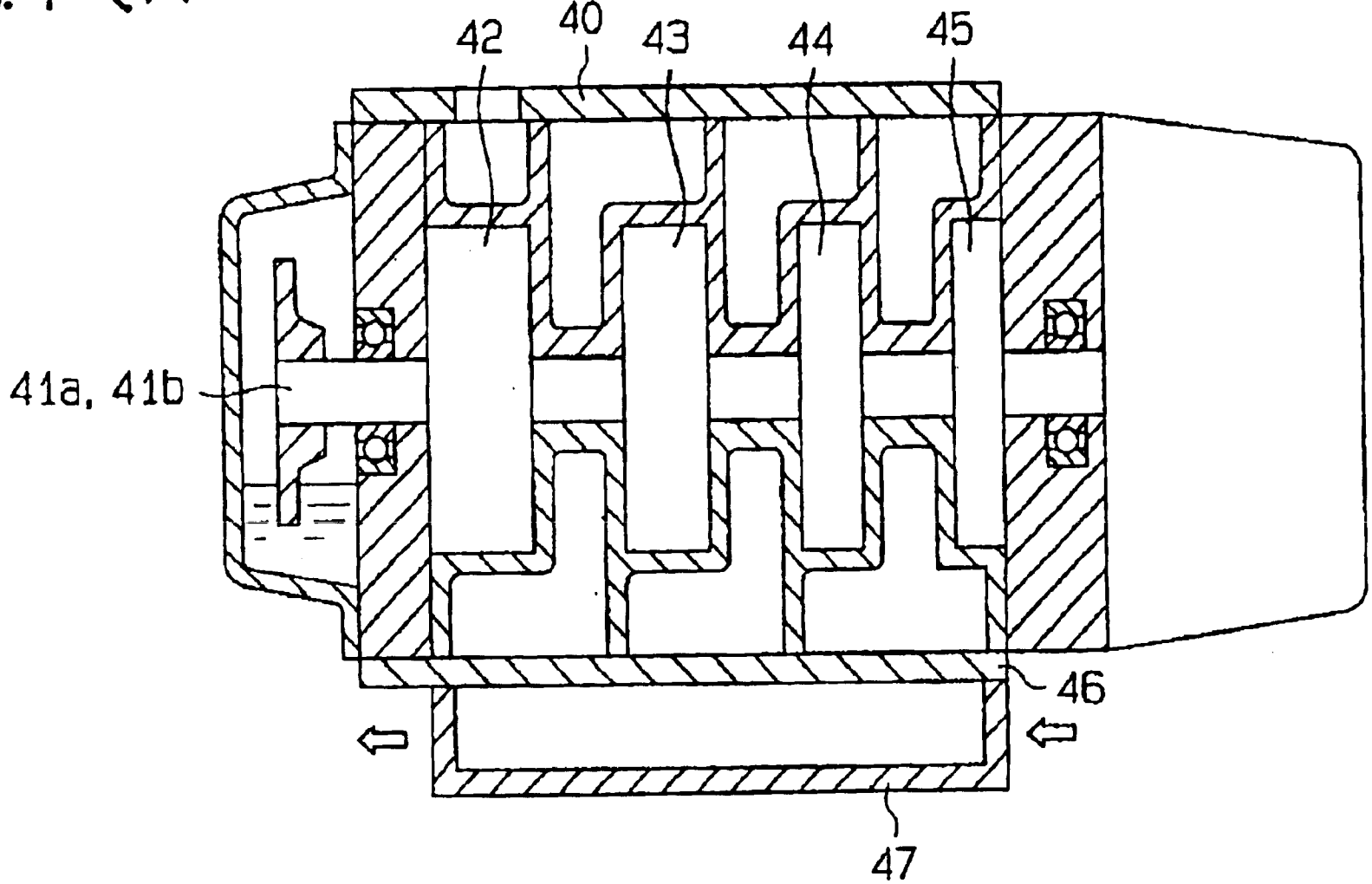
Fig. 9 (PRIOR ART)
FIG. 9 is a partial cross-sectional view of a principal or main portion of a conventional "Roots"-type multi-stage vacuum pump.

Referring to FIG. 8, there is illustrated a "Roots"-type multi-stage vacuum pump in accordance with a sixth embodiment of the present invention which is characterized in providing or adding a check valve 49 at the outlet port 4 of the pump 1 of the first embodiment.

The check valve 49 is designed to allow the gas flow from the passage 24 to the outlet port 4 but to limit or stop the gas flow from the outlet port 4 to the passage 24, which prevents an entrance or invasion of atmospheric air inside the pump 1 by way of the passage 24 (i.e. a reverse flow of the gas resulting from pressure differential). Thus, the atmospheric air is prevented from being flown into the space to be evacuated, resulting in prevention of drawbacks caused by abrupt pressure change such as damages of the pump 1 per se and the space to be evacuated and in expectation of noise reduction or sound deadening effect.

[Supplementary Explanation]

In the above-described embodiments, the number of pumping stages is set to be 5. However, this is not a limited value and therefore the present invention can be applied to any pump regardless of pumping stage number. In addition, it is possible to introduce an inert gas inside the pump 1 for decreasing the pressure in each of the pumping chambers when exhausting the gas which is easy to condensate or deposit from the outlet port 4.

[Advantages of the Invention]

In accordance with the present invention, the passage which is formed in the housing is made extended from the final stage pumping chamber to the first stage pumping chamber for doing the first gas compression, which moves to the first stage pumping chamber, the high-temperature gas resulting from compression load upon exhaustion from the final stage pumping chamber, causes at the lowest temperature of the first stage pumping chamber to increase while the pump is in operation. Thus, it is possible to make the temperature differential as small as possible between the first stage pumping chamber and the final stage pumping chamber, and therefore even if the gas contains a substance which is easy to condensate the first stage pumping chamber which of the lowest heat of compression is made free from the possible solidification of such a substance. Of course, other pumping chambers and the passages are also made free from the solidification of the substances which is easy to condensate.

The above-mentioned structure makes it easy to establish an easy way prevention of the solidification and to evacuate surely the space to be evacuated.

In the above-structure, providing a cooling passage near the passage makes it possible to cool efficiently the pump housing.

If the above-mentioned passage is defined in a tube which is in thermal contact with the pump housing, the cooling fluid flowing through the tube fail to corrode the pump housing.

In addition, the passage is so formed as to extend along the lengthwise axis of the pump housing for being in coincidence with the shape of each of the pumping chambers, which makes it possible to establish an accurate temperature control of the pump for the prevention of the solidification of the easy-to-condensate substance such that as a whole the temperature differential is made minimum between any of two pumping chambers.

Furthermore, forming heat-radiation fans on the pump housing make it possible to establish an easy way air-cooling of the pump housing It is possible to make the passage to have inexpensive sound deadening function by suitable fashion such as adjusting the cross-sectional area or volume of the passage, making the shape of the passage irregular or bent, or providing a sound-absorbing material. Forming such a built-in silencer eliminates an eternal silencer, which is not accompanied by the increase of the number of the parts of the pump.

Moreover, providing the check valve in the outlet port prevents an entrance or invasion of dusts in air inside the pump, thereby making the pump free from its malfunction. This prevents the product in process from being made inferior or defective.

The invention has thus been shown and description with reference to specific embodiments, however, it should be understood that the invention is in no way limited to the details of the illustrates structures but changes and modifications may be made without departing from the scope of the appended claims.

What is claimed is:

1. A multi-stage vacuum pump comprising: a housing in which a plurality of pumping chambers are formed, the pumping chambers being arranged in series and being in fluid communication with one another, one of the pumping chambers which is at one end of the series acting as an initial stage pumping chamber, another of the pumping chamber which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pumping chamber; a Roots-type pump section occupying each of the pumping chambers; and first means for decreasing a temperature differential between the initial stage pumping chamber and the final stage pumping chamber, wherein the inlet port and the outlet port of the housing are placed near the initial stage pumping chamber, the first means is in the form of a passage connecting between the inlet port and the outlet port.

2. A multi-stage vacuum pump as set forth in claim 1, wherein the passage extends along a lengthwise axis of the housing.

3. A multi-stage vacuum pump as set forth in claim 1, wherein the passage is modified to act concurrently as a built-in silencer.

4. A multi-stage vacuum pump wherein the vacuum pump as set forth in claim 3, wherein the passage is made to have different inner diameters to form the built-in silencer.

5. A multi-stage vacuum pump as set forth in claim 3, wherein the passage is curved to form the built-in silencer.

6. A multi-stage vacuum pump as set forth in claim 3, wherein a sound-absorbing material is provided in the passage to form the built-in silencer.

7. A multi-stage vacuum pump as set forth in claim 1 further comprising second means for cooling a heat of compression generated at each of the pumping chambers.

8. A multi-stage vacuum pump as set forth in claim 7, wherein the second means is in the form of one more cooling fluid flowing passages which are so formed in the housing as to be near the first means.

9. A multi-stage vacuum pump as set forth in claim 8, wherein the cooling fluid flowing passage is a tube which is in thermal contact with the housing.

10. A multi-stage vacuum pump as set forth in claim 7, wherein the second means is in the form of fins formed integrally with the housing.

11. A multi-stage vacuum pump as set forth in claim 1 further comprising a check-valve provided in the outlet port.

* * * * *